US005538170A

United States Patent [19]

Van Luit

[11] Patent Number: 5,538,170

[45] Date of Patent: Jul. 23, 1996

[54] TAPE TENDER

[76] Inventor: Richard Van Luit, 3029 N. Island Cir., Port Clinton, Ohio 43452

[21] Appl. No.: 287,595

[22] Filed: Aug. 8, 1994

[51] Int. Cl.[6] ..... B26F 3/02

[52] U.S. Cl. ..... 225/47; 225/53; 225/77; 225/90; 242/597.4

[58] Field of Search ..... 225/39, 46, 47, 225/53, 77, 90, 91, 41, 45; 242/48, 129, 129.1, 129.5, 136, 137, 137.1, 138, 139, 140, 146, 405, 405.3, 588, 588.2, 588.3, 588.6, 597, 597.1, 597.4

[56] References Cited

U.S. PATENT DOCUMENTS

| | | | |
|---|---|---|---|
| 1,131,591 | 3/1915 | Baker | 225/77 X |
| 1,837,180 | 12/1931 | Bennett, Jr. et al. | 225/47 X |
| 2,622,815 | 12/1952 | Waterman | 225/47 X |
| 2,817,404 | 12/1957 | Vogt | 225/91 X |
| 2,929,540 | 3/1960 | Carey | 225/51 X |
| 3,123,265 | 3/1964 | Houser | 225/77 X |
| 3,993,230 | 11/1976 | Oakes | 225/77 X |
| 4,061,290 | 12/1977 | Harrill | 242/405.3 X |
| 4,244,536 | 1/1981 | Harrill | 242/405.3 |
| 4,282,954 | 8/1981 | Hill | 242/405.3 X |
| 4,466,581 | 8/1984 | Hill | 242/405.3 X |
| 4,881,675 | 11/1989 | Varley, III | 225/53 X |

FOREIGN PATENT DOCUMENTS 1447904 9/1976 United Kingdom .

*Primary Examiner*—Rinaldi I. Rada
*Assistant Examiner*—Clark F. Dexder
*Attorney, Agent, or Firm*—Terrance L. Siemens

[57] ABSTRACT

A combined tape reel storage, transport, and dispensing device has a core supporting axle holding a tape roll for free rotation within a generally cylindrical durable polypropylene housing. Tape is fed through a tangential feed slot, over a support ledge, and beneath a V-shaped cutter. The cutter smoothly severs a desired length of tape without twisting or binding. The recessed cutting edge also prevents the user from jabbing or cutting themselves. A finger sized slot in the cutter allows precise and safe feeding and starting of the tape unwinding process. An integral carrying handle is incorporated into the housing top and a flat support surface is incorporated into the housing bottom. An integral central boss forms the axle for supporting the spool of tape. A flat retaining bar secures the tape within the housing while providing instant visual inspection of the remaining tape on the reel. The retaining bar is secured to the housing with a quickly removable wing nut or other quick fastener to allow easy replacement of tape spools.

4 Claims, 3 Drawing Sheets

TAPE TENDER

BACKGROUND OF THE INVENTION

1. Field of the Invention

The present invention relates to a tape storage, carrying, and dispensing device referred to hereinafter as a tape tender. More specifically, it relates to a tape tender for non-adhesive plastic barricade and identification tape. Such tape is commonly used by police, construction companies, fire departments, utility companies, and other organizations having the need to post temporary warning barricades and the like. Even more specifically, an improved tape reel dispenser having excellent portability and a superior tape cutting mechanism is disclosed.

The fields of construction, police and fire protection, and public utility provision are seen as the most likely benefactors of the unique advantages of the instant invention. However, many other fields, such as crowd control at large entertainment events, could find potentially beneficial uses for this invention.

Thus it can be seen that the potential fields of use for this invention are myriad and the particular preferred embodiment described herein is in no way meant to limit the use of the invention to the particular field chosen for exposition of the details of the invention.

A comprehensive listing of all the possible fields to which this invention may be applied is limited only by the imagination and is therefore not provided herein. Some of the more obvious applications are mentioned in the interest of providing a full and complete disclosure of the unique properties of this previously unknown general purpose article of manufacture. It is to be understood from the outset that the scope of this invention is not limited to these fields or to the specific examples of potential uses presented herein.

2. Description of the Prior Art

Devices for dispensing and transporting spools of plastic web material are old and well known in the prior art. The best known example is probably the familiar SARAN WRAP combined packaging box and dispenser. SCOTCH tape dispensers are another common example. There abound numerous other examples of dispensing devices of wound reels of flat sheet material of indeterminate length. A common feature of all these devices is that they must provide some means of cutting the sheet material to a desired length after the appropriate amount has been unwound from the spool. Most people who have wrestled with mailing tape spools that will not tear off without sticking to themselves and causing a complete mess, will recognize that room for improvement still exists in most of these cutting and dispensing devices.

Recently, economical brightly colored plastic banner with preprinted messages have become available on the market wound on large spools of great length. Common messages imprinted thereon are "CAUTION DO NOT ENTER", "POLICE LINE DO NOT CROSS", "PRIVATE PROPERTY", and the like. In accordance with conventional terminology, the term barricade tape will be used to describe such tape. Barricade tape may or may not include adhesive for attaching it to external objects. The following known prior art has been directed to providing means for dispensing rolls of flexible material. As will be seen, the simplicity and effectiveness of my invention is not rivaled in the prior art.

U.S. Pat. No. 2,683,641, issued to Conrad N. Larson on Jul. 13, 1954, shows a roll paper dispenser designed to facilitate the filling of a dispenser and to enable measured removal of the paper therefrom without undesirable displacement or jamming of the roll. The patented roll dispenser completely surrounds the roll thus preventing instant determination of the amount of roll remaining. The patented device uses a straight serrated cutting edge, thus forcing the user to cock the paper to one side or the other to begin the cutting process at one edge of the paper or the other. The patented device supports the weight of the roll from its outer circumference thus requiring considerable force to be applied to effect unreeling of the roll and tends to mar the surface of the dispensed portion of the roll. Finally, the patented device shows no carrying handle for the unit.

By contrast, the instant invention has an open side allowing instant visual determination of the amount of tape remaining. The instant invention has a V-shaped cutting edge allowing cutting of the tape from the center toward each edge without twisting or cocking. The instant invention supports the weight of the roll from a central core or axle which allows tape to be removed with minimal force without marring the tape surface. Finally, the instant invention is equipped with a convenient carrying handle.

U.S. Pat. No. 2,861,753, issued to Joseph F. Sipior on Nov. 25, 1958, shows a paper dispensing device. The patent shows spaced flanges providing a tear off means through which the paper is drawn. The paper may be pulled out to a desired length and then torn off. An accessible reserve portion remains easily graspable after a desired portion is torn off. The patented device uses a straight serrated cutting edge, thus forcing the user to twist or cock the paper to one side or the other to begin the cutting process at one edge of the paper or the other. The patented device supports the weight of the roll from its outer periphery thus requiring considerable force to be applied to effect unreeling of the roll and tending to mar the surface of the dispensed portion of the roll. The patented device shows no carrying handle for the unit.

By contrast, the instant invention has a V-shaped cutting edge allowing cutting of the tape from the center toward each edge without twisting or cocking. The instant invention supports the weight of the roll from a central core or axle which allows tape to be removed with minimal force without marring the tape surface. Finally, the instant invention is equipped with a convenient carrying handle.

U.S. Pat. No. 3,082,922, issued to Harold Warp on Mar. 26, 1963, shows a rolled-sheet tearing means. The patent shows a straight serrated edge extending outwardly from a housing. The patented tearing means does not contemplate an open housing allowing instant determination of the amount of roll remaining. The patented device uses a straight serrated cutting edge, thus forcing the user to cock the sheet to one side or the other to begin the cutting process at one edge of the sheet or the other. The patented device does not contemplate supporting the weight of the roll from an axle through the inner core. Finally, the patented device shows no carrying handle for the unit.

By contrast, the instant invention has an open side allowing instant visual determination of the amount of tape remaining. The instant invention has a V-shaped cutting edge allowing cutting of the tape from the center toward each edge without twisting or cocking. The instant invention supports the weight of the roll from a central core or axle which allows tape to be removed with minimal force without marring the tape surface. Finally, the instant invention is equipped with a convenient carrying handle.

U.S. Pat. No. 2,597,602 issued to Joseph F. Sipior on May 20, 1952, shows several variations of paper dispensing devices. The patent generally shows straight serrated cutting edges for cutting the paper, thus forcing the user to cock the sheet to one side or the other to begin the cutting process at one edge of the sheet or the other. Also, none of the variations show a carrying handle.

By contrast, the device of the instant invention has a V-shaped cutting edge allowing cutting of the tape from the center toward each edge without twisting or cocking. In addition, the instant invention is equipped with a convenient carrying handle.

U.S. Pat. No. 3,237,826, issued to Norbert A. Ringholz et al. on Mar. 1, 1966, shows a shipping and dispensing container. A foldable carton encloses a rolled sheet for dispensing through an offset slot. The patented roll dispenser completely surrounds the roll thus preventing instant determination of the amount of roll remaining. The patented device uses a straight serrated cutting edge, thus forcing the user to cock the paper to one side or the other to begin the cutting process at one edge of the paper or the other. The patented device supports the weight of the roll from its outer circumference thus requiring considerable force to be applied to effect unreeling of the roll and tending to mar the surface of the dispensed portion of the roll. Finally, the patented device shows no carrying handle for the unit.

By contrast, the instant invention has an open side allowing instant visual determination of the amount of tape remaining. The instant invention has a V-shaped cutting edge allowing cutting of the tape from the center toward each edge without twisting or cocking. The instant invention supports the weight of the roll from a central core or axle which allows tape to be removed with minimal force without marring the tape surface. Finally, the instant invention is equipped with a convenient carrying handle.

It will be noted that none of the prior art devices provide any sort of carrying handle for the tape dispenser. None of the prior devices shows a V-shaped cutting edge for cutting a tape from the center outwards. None of the prior art devices shows the unique finger tape advance of this invention. In addition, none of the prior art devices shows the unique tape retaining bar shown by this invention.

None of the above inventions and patents, taken either singly or in combination, is seen to describe the instant invention as claimed.

SUMMARY OF THE INVENTION

Briefly, the invention comprises a combined tape reel storage, transport, and dispensing device. A core supporting axle holds the tape reel for free rotation within a generally cylindrical durable polypropylene housing. Tape is pulled out a tangential feed slot, over a support ledge, and beneath a V-shaped cutter. The cutter smoothly severs a desired length of tape without twisting or binding. A finger sized slot in the cutter allows precise feeding and starting of the tape unwinding process. An integral carrying handle is incorporated into the housing top and a flat support surface is incorporated into the housing bottom. An integral central boss forms the axle for supporting the spool of tape. A flat retaining bar secures the tape within the housing while providing instant visual inspection of the remaining tape on the reel. The retaining bar is secured to the housing with a quickly removable wing nut to allow easy replacement of tape spools.

Accordingly, it is a principal object of the invention to provide a new and improved tape tender device which overcomes the disadvantages of the prior art in a simple but effective manner.

It is a major object of this invention to provide a tape tender that provides a protective housing for storing and transporting a large roll of barricade tape wound on a spool.

It is another object of the invention to form the protective housing with smooth rounded exterior surfaces so as to minimize snagging on other objects during transport.

It is another object of the invention to form the protective housing generally as a cylinder conforming closely with the shape of the roll of tape so as to minimize the weight and volume of the unit.

It is another object of the invention to provide the generally cylindrical protective housing with a smooth feed slot generally aligned tangentially with the tape roll for feeding the tape through the slot with a minimum amount twisting, friction, and abrasion.

It is another object of the invention to provide the generally cylindrical protective housing with an integral outer support ledge beneath the feed slot for supporting and guiding the tape as it passes through the slot.

It is another object of the invention to provide a flat metal guide means parallel and closely proximate to the support ledge for preventing the tape from bending or kinking as it passes over the support ledge.

It is another object of the invention to provide the metal guide means with a generally V-shaped cutting edge for severing a desired length of tape from said roll with a balanced cutting action which imparts no sideways or twisting force to the tape during cutting, thus obviating the natural tendency of a thin tape to tangle and snarl.

It is another object of the invention to provide a pair of cutting edges set in a V-shape to prevent the user from jabbing or cutting themselves.

It is another object of the invention to provide the metal guide means with an elongated finger slot to assist in manually feeding a short length of the tape past the cutting edge with safety by allowing starting of the unwinding process without grasping in the vicinity of the sharpened cutting edge.

It is another object of the invention to provide the generally cylindrical protective housing with a flat bottom foot surface forming a portable stable support for the tape roll wherever it is set upon the ground.

It is another object of the invention to provide the generally cylindrical protective housing with an integral carrying handle opposite the flat bottom surface.

It is another object of the invention to provide the generally cylindrical protective housing with an integral central axle supporting a core of the tape roll for free rotation about its axis to minimize resistance to unwinding.

It is another object of the invention to provide the generally cylindrical protective housing with an open end for ease of tape roll replacement, starting a new tape through the feed slot, and instant visual determination of the amount of tape remaining on the roll.

It is another object of the invention to provide a removable retaining bar across the open end of the protective housing for retaining the tape roll in position during use and for easy removal during tape roll replacement.

Finally, it is a general goal of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

The present invention meets or exceeds all the above objects and goals. Upon further study of the specification and appended claims, further objects and advantages of this invention will become apparent to those skilled in the art.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENT

Figure 1:
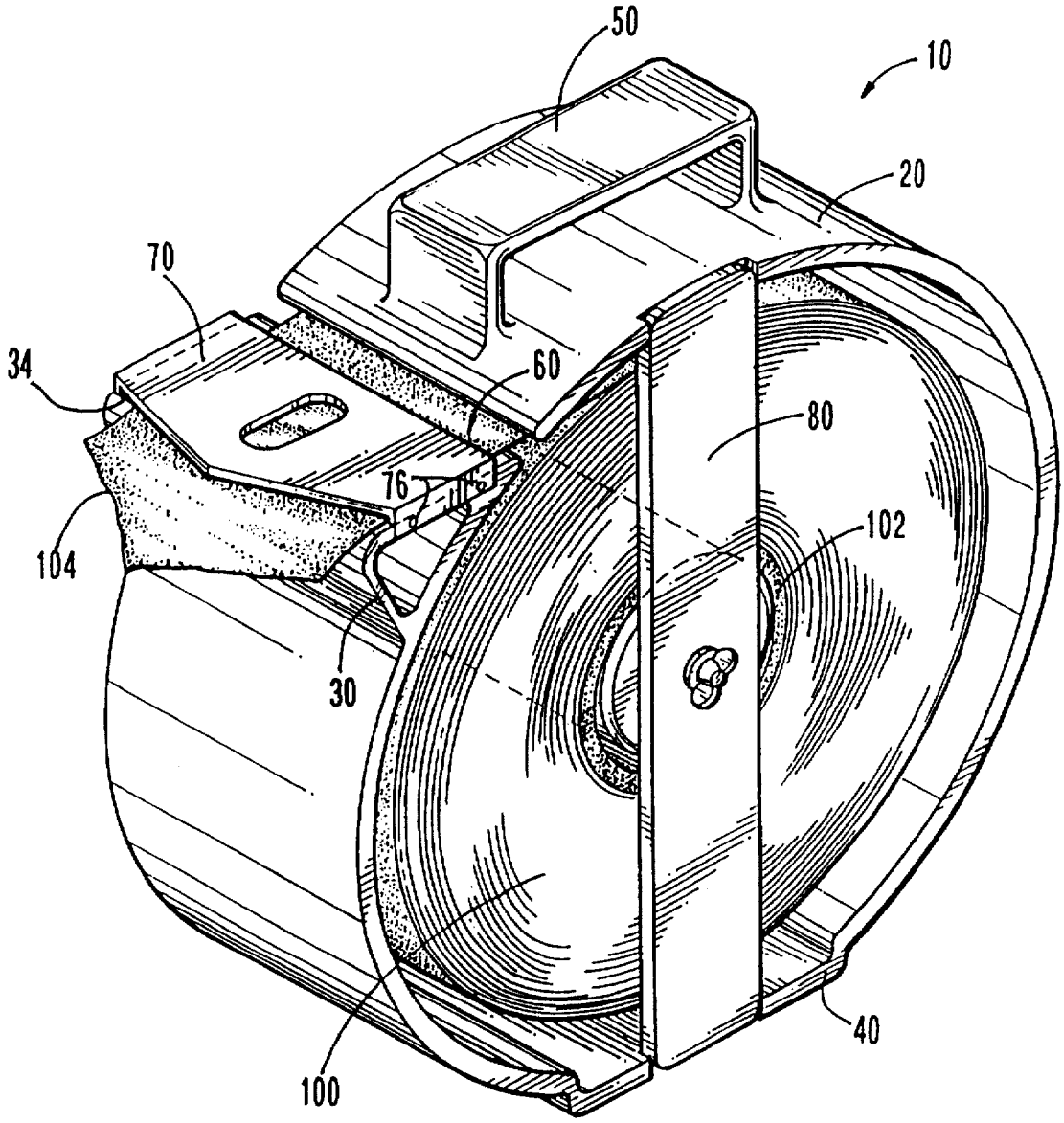
FIG. 1 is a perspective view of the invention showing a tape roll mounted in the housing and ready for use.
Figure 3:
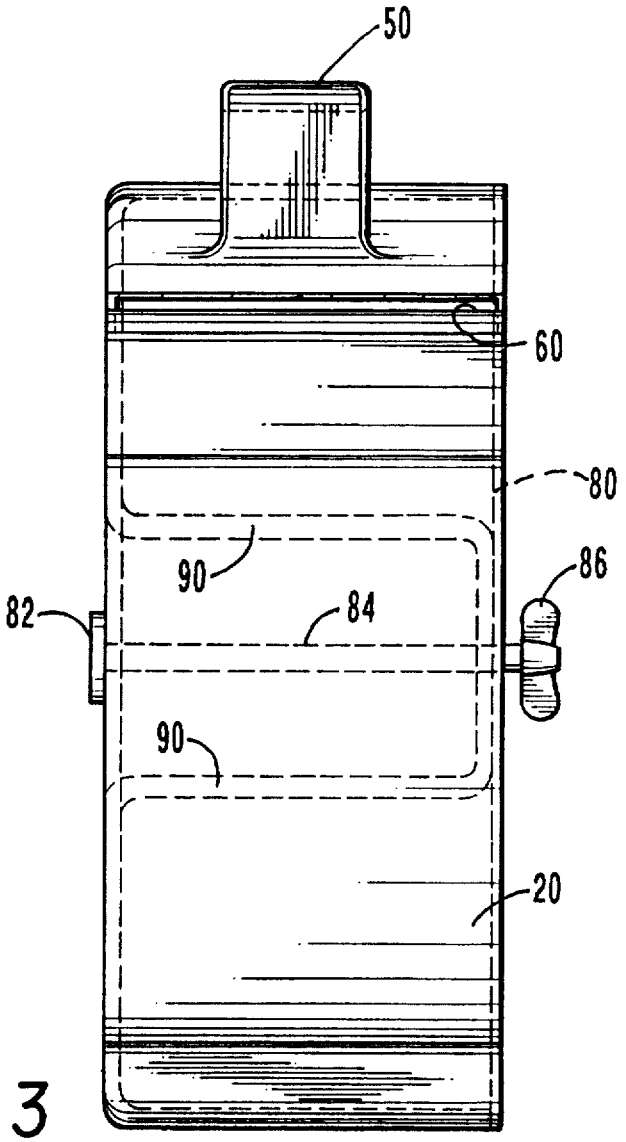
FIG. 3 is a front view of the housing showing the central axle and the retaining bar attachment means.

The tape tender of the present invention is generally designated by arrow 10 of FIG. 1. The device comprises the following main parts; open-ended generally cylindrical housing 20, tape support ledge 30, generally flattened portion bottom 40, carrying handle 50, feed slot 60, tape guide and cutter 70, tape retaining bar 80, and central axle 90 (FIG. 3). FIG. 1 also shows a conventional roll of barricade tape 100 mounted in the unit as it would be in use.

The barricade tape 100 is generally brightly colored for easy visibility and may be imprinted with indicia as previously mentioned. The tape is usually a thin plastic and the tape rolls come in lengths of up to 1200 feet and standard widths of three inches. The tape may include an adhesive coating on one side for instant attachment to external objects. The adhesive may or may not be covered with a peel-off protective coating. It is contemplated that the tape could be coated with recontact adhesive to allow reuse if desired, but the tape is generally disposed after one use. The instant invention is capable of easily storing, protecting, transporting, and dispensing any type of tape. The tape is generally wound around a fiberboard core such as 102, and this invention takes advantage of that core as described later with respect to the central axle 90 (FIG. 3).

Generally cylindrical housing 20 is molded from durable lightweight polypropylene and forms the major structural component of the invention. The housing 20 has one open end face with upper and lower notches 24 and 22 (FIG. 4) formed to hold retaining bar 80 described later. The general dimensions of the cylindrical housing are just sufficient to comfortably contain the largest tape roll to be handled for that particular model. Conforming housing 20 with the size and shape of the dispensed tape roll in this manner reduces bulk, weight, and expense of the invention.

The lower portion of housing 20 is formed as a generally flattened bottom portion 40. The flat lower surface of bottom portion 40 is designed to provide stable support of housing 20 and enclosed tape roll 100 on any reasonably level surface. The flattened bottom portion 40 is designed to provide specifically a large surface contact area 42 (FIG. 4) so as to prevent the device from sinking or tipping on muddy ground. The artisan will recognize that it would be obvious to design the support surface with feet, legs, or other support structure for specific applications which may arise. It is also contemplated that the bottom portion could be configured with attachment items cooperating with specialized structure in the intended environment of use. For example, the foot could be configured to slip around a sawhorse being used to configure a corner of the tape barrier. As another example, the bottom portion could be configured to mate with a ground piercing stake.

The upper portion of housing 20 is formed with an integral carrying handle 50. Handle 50 is formed so as to allow passage of all fingers of one hand for easy grasping. It is contemplated that appropriate finger indentations, etc. could be formed on the hand engaging surfaces for comfort and ease of handling. The opening between the housing and the upper portion of handle 50 is sufficient to allow easy passage of a gloved hand. The position of handle 50 is generally arranged directly above the center of gravity of the loaded unit so as to hang straight during carrying. It is, however, contemplated that the handle could be offset slightly to one side so as to cause the housing to tilt slightly away from the users feet and legs during carrying.

Feed slot 60 is generally parallel to the longitudinal axis of the cylindrical housing 20 the tape roll carried therein. The edges of feed slot 60 are generously rounded to prevent snagging of the tape as it is fed out through the slot. The slot is positioned around the periphery of the housing near the upper side to provide ground clearance for the exiting tape when the housing is placed on the ground. The width of the slot is sufficient to allow tangential unwinding of the tape roll from the top, and to allow free passage through the slot with minimal frictional contact with either side of the slot.

Support and guide ledge 30 is formed in housing 20 near the outside lower edge of feed slot 60. The ledge provides a flat, tangentially extending surface 32 (FIG. 4) upon which tape 100 may rest upon withdrawal from roll 100. Another function of ledge 30 is to provide a mounting surface for tape guide and cutter 70. Ledge 30 is illustrated as a hollow appendage integrally molded with housing 20. The artisan will recognize that a similarly functioning ledge could be solid. Also it is not necessary to form the ledge as an integral part of the housing although that is my preferred embodiment. Certainly another alternative would be to form the ledge and tape cutter as a separate integral unit and then attach that unit to the cylindrical housing.

Tape guide and cutter 70 is preferably made of metal and attached along its sides at 76 so as to be generally close and parallel to the flat surface 32 of ledge 30 while leaving a thin wide opening slightly wider and thicker than the tape. This thin wide opening, designated at 34 in FIG. 1 forms a tape guide. The outer front edge of guide and cutter 70 is a V-shaped sharpened cutter edge 72 and is mounted behind the outer most part of tape ledge 30. The V-shaped cutting edge is an important feature of the invention. When it is desired to sever a length of tape that has been unwound from the roll, a user need only lift upwardly upon the tape. The point of the V easily punctures a hole near the center of the tape. As the user continues to pull upward the portions of tape on each side of the puncture are exposed to the angled sharp cutter edges 72. The sideways force on the tape of one cutter edge on one side of the V is exactly counterbalanced by an equal but opposite sideways tape force on the other side of the V. Thus, the net sideways or twisting force on the tape roll is cancelled to zero. The tape is therefore severed cleanly without exerting any undesirable tangling forces on the remaining roll.

Figure 2:
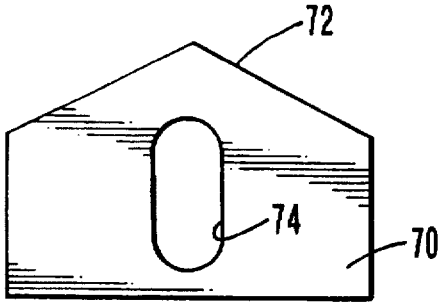
FIG. 2 is a top view of the combined tape cutter and guide means of the invention showing, in particular, the finger guide slot.

The upper flat surface of tape guide-cutter 70 is formed with a finger sized aperture 74 best seen in FIG. 2. This aperture has multiple purposes. When threading a new tape over ledge 30, aperture 74 may be used to push the end of the tape onward through the thin opening 34 between the ledge and the guide-cutter 70. Thin opening 34 allows tape from tape roll 100 to exit housing 20, while also providing a guide maintaining exiting tape from roll 100 in a tangential orientation to the roll of tape 100. When severing a desired length of tape from the roll, aperture 74 may be used to hold the roll of tape from unwinding when the puncture or tear is first started. After a piece of tape has been removed and it is again desired to dispense more tape, it is possible to eject a short length of tape using aperture 74. This then allows safe grasping of the tape end for further removal without placing the hands near the potentially dangerous cutting edges 72. The cutting edges 72 are angled rearwardly in a V-shape in relation to the lip of tape support ledge 30. This then prevents accidental injury to the user.

Figure 4:
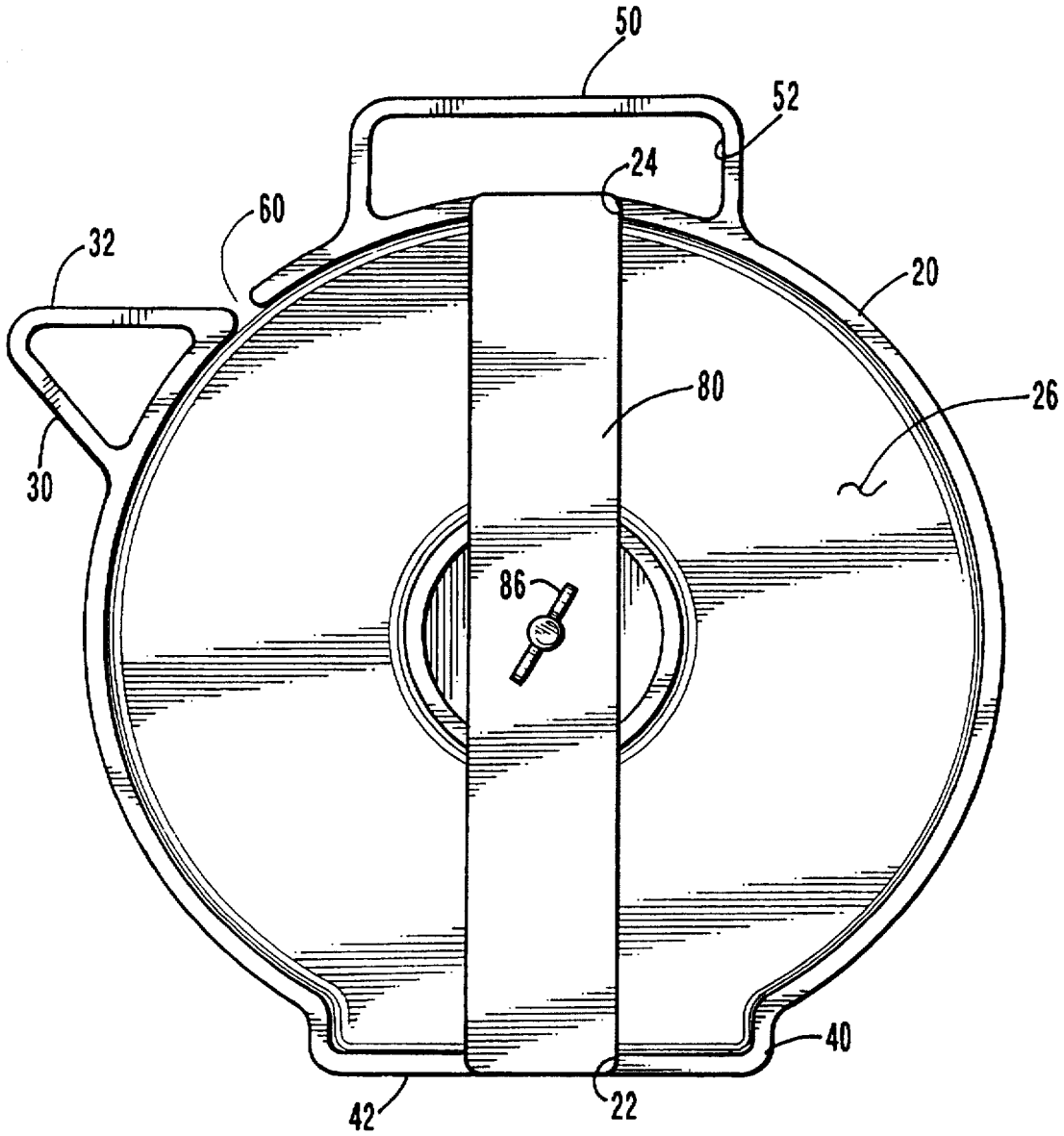
FIG. 4 is side view of the housing looking toward the open side and showing, in particular, the handle, feed slot, support ledge, and bottom foot surface.

Opposite the open face of housing 20 is solid circular back wall 26 (FIG. 4). Protruding inwardly from wall 26 across the center of housing 20 is a hollow central axle 90. Axle 90 is smaller than conventional tape core 102 and supports a tape roll thereon for relatively free rotation. It is contemplated that this simple rotational support will be sufficient for purposes of an economical version of the invention. The slight frictional moment holding the tape core from unreeling should be about right to prevent unwanted free-wheeling after a length of tape has been removed. The artisan will recognize that, for additional expense, a free turning bearing along with a suitable brake means could be used as well.

Retainer bar 80 is simply a long flat bar with a central aperture. The length of bar 80 is sufficient to extend between slot 24 located at the top of housing 20 and slot 22 located on foot 40, bar 80 thus passing across the open face of housing 20. Bar 80 does not protrude, however, above housing 20 into the area of carrying handle 50 or below housing 20 beneath the flat surface contact area 42 of the flattened bottom portion 40. As best seen in FIG. 3, bar 80 is held temporarily in place by wing nut 86 on threaded rod 84 passing through the hollow central axle 90 of housing 20. The opposite end of rod 84 has a head 82 abutting the closed face of housing 20 and holding the rod centrally. Retaining bar 80 also serves multiple functions. Most obviously it prevents the wound portion of the tape roll from dislodging from the roll during transport or rough handling. When bar 80 is removed by removing wing nut 86 the entire side of the tape roll is exposed and core 102 may be slid off central axle 90. A new roll may be placed on axle 90 after the old core is removed. The retaining bar (as opposed to a fully closed face) also serves the function of allowing instant visual determination of the amount of tape remaining on the roll. The retaining bar may also be embossed with advertising or identifying indicia. This may be used to indicate such information as model number and manufacturer, or personalized user information. For example, the bar could be embossed with "New York City Police" on all items sold to that user. The retaining bar itself is a relatively inexpensive portion of the overall unit and thus lends itself well to such custom imprinting or embossing.

From the foregoing description, one skilled in the art can easily ascertain the essential characteristics of this invention and, without departing from the spirit and scope thereof, can make various changes and modifications of the invention to adapt it to various usages and conditions. For example, the artisan could easily ascertain that the cutting and guide means could be made of tough plastic rather than the preferred metal. Also the cutting surface could be a straight serrated edge if desired. The overall shape and dimensions of the device may also be suitably varied to satisfy special requirements and environments.

It is to be understood that the present invention is not limited to the sole embodiment described above, but encompasses any and all embodiments within the scope of the following claims:

I claim:

1. A non-adhesive barrier tape storage, carrying, and dispensing device comprising:

a generally cylindrical hollow housing for surrounding and carrying a cylindrical roll of non-adhesive barrier tape, said housing having a longitudinal axis, one closed circular end face, one open circular end face, and a circumferential outer wall spanning said closed circular end face and said open circular end face;

a feed slot disposed parallel to said axis, said feed slot extending across said circumferential outer wall of said housing, said feed slot enabling passage of tape from the roll of tape to the exterior of said housing;

a guide for guiding and supporting said tape as it is dispensed from said housing, said guide comprising;

a horizontal ledge having a flat surface integral with and projecting outwardly from said circumferential outer wall, and cutting means for cutting tape dispensed from said housing, said cutting means affixed above said ledge to form an elongated opening therebetween to surround said tape as it exits from said feed slot and is supported by said ledge, said guide disposed proximate said feed slot, whereby dispensed tape is guided and supported as it exits said housing;

said housing further comprising notch means defining two notches disposed upon said circumferential wall at said open circular end face, said notches located diametrically opposed to one another;

said device further comprising a retaining bar, extending entirely across said open circular face of said housing and having the ends of said bar situated in said notches for retaining the roll of non-adhesive barrier tape securely within said housing while enabling visual verification of the amount of tape remaining on the roll and substantially preventing axial slippage of one layer of the tape roll from another layer;

said device also having removable attachment means for firmly holding said retaining bar in place and enabling removal of said retaining bar for the purpose of exchanging the roll of tape with another roll of tape;

a handle attached to said circumferential outer wall of said housing for carrying said device; and a generally flat surface engagement portion integral with said housing, for supporting said housing on a horizontal surface.

2. The non-adhesive barrier tape storage, carrying, and dispensing device according to claim 1, wherein said cutting means comprises;

a wide, thin, flat bar overlying said ledge to form said elongated opening and including a V-shaped cutting edge having a point extending outwardly from said bar, whereby said V-shaped cutting edge punctures a center portion of tape when the tape is manually lifted into and against said point of said cutting edge, and the tape is thereby severed outwardly toward its edges in both directions by said cutting edge as the tape continues to be lifted, thereby effectively severing the tape while obviating any twisting or tangling.

3. The non-adhesive barrier tape storage, carrying, and dispensing device according to claim 2, wherein said cutting means further comprises;

finger aperture means formed in the center of said wide, thin, flat bar for applying manual force against the tape urging the tape against said ledge to hold the tape in place during cutting.

4. The non-adhesive barrier tape storage, carrying, and dispensing device according to claim 1, said housing further comprising a hollow central axle extending from said closed circular end face towards said open circular end face, said axle for supporting a hollow core of the roll of tape for free rotation thereon.

* * * * *